US006183925B1

(12) United States Patent
Kohri et al.

(10) Patent No.: US 6,183,925 B1
(45) **Date of Patent: *Feb. 6, 2001**

(54) TWO COMPONENT DEVELOPER COMPRISING SPECIFIC MAGNETIC TONER AND SPECIFIC MAGNETIC CARRIER

(75) Inventors: Toshitaro Kohri, Higashiosaka; Akihiro Nakamura, Toyonaka; Yoshimasa Nishihara, Amagasaki, all of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 08/723,248

(22) Filed: Sep. 30, 1996

Related U.S. Application Data

(63) Continuation of application No. 08/324,532, filed on Oct. 18, 1994, now Pat. No. 5,663,027, which is a continuation of application No. 08/118,284, filed on Sep. 9, 1993, now abandoned, which is a continuation of application No. 07/891,926, filed on Jun. 1, 1992, now abandoned, which is a continuation of application No. 07/634,395, filed on Dec. 27, 1990, now abandoned.

(30) Foreign Application Priority Data

Dec. 28, 1989 (JP) ..... 1-339951
Dec. 28, 1989 (JP) ..... 1-339952

(51) Int. Cl.[7] ..... G03G 9/083
(52) U.S. Cl. ..... 430/106.6; 430/108; 430/111
(58) Field of Search ..... 430/106.6, 108, 430/110, 111

(56) References Cited

U.S. PATENT DOCUMENTS

| | | | | |
|---|---|---|---|---|
| 2,846,333 | | 8/1958 | Wilson . | |
| 2,874,063 | | 2/1959 | Greig . | |
| 3,345,294 | | 10/1967 | Cooper . | |
| 3,996,392 | | 12/1976 | Berg et al. . | |
| 4,082,681 | | 4/1978 | Takayama et al. . | |
| 4,111,823 | | 9/1978 | Kobayashi et al. . | |
| 4,262,076 | * | 4/1981 | Hakumoto et al. | 430/106.6 |
| 4,287,282 | | 9/1981 | Miyakawa et al. . | |
| 4,517,268 | * | 5/1985 | Gruber et al. | 430/106.6 |
| 4,520,092 | | 5/1985 | Knapp et al. . | |
| 4,535,049 | * | 8/1985 | Honda et al. | 430/106.6 |
| 4,578,337 | * | 3/1986 | Oka | 430/106.6 |
| 4,600,675 | | 7/1986 | Iwasa et al. . | |
| 4,654,287 | | 3/1987 | Okuyama et al. . | |
| 4,702,775 | | 10/1987 | Ostertag et al. . | |
| 4,702,986 | | 10/1987 | Imai et al. . | |
| 4,758,490 | | 7/1988 | Kitabatake . | |
| 4,820,603 | | 4/1989 | Sakashita . | |
| 4,822,709 | | 4/1989 | Ohtani et al. . | |
| 4,902,597 | | 2/1990 | Takeda et al. . | |
| 4,912,005 | | 3/1990 | Goodman et al. . | |
| 4,935,325 | | 6/1990 | Kuribayashi et al. . | |
| 4,937,157 | | 6/1990 | Haack et al. . | |
| 4,939,060 | | 7/1990 | Tomiyama et al. . | |
| 4,988,598 | * | 1/1991 | Tomono et al. | 430/110 |
| 5,004,665 | | 4/1991 | Ohtani et al. . | |
| 5,053,305 | | 10/1991 | Aoki et al. . | |
| 5,084,368 | * | 1/1992 | Hirayama et al. | 430/109 |
| 5,260,160 | | 11/1993 | Aoki et al. . | |
| 5,663,027 | * | 9/1997 | Kohri et al. | 430/106.6 |

OTHER PUBLICATIONS

Chemical Abstracts Registry No. 1309–37–1, 2000.*
"Electrophotography", R. M. Schaffert, John Wiley & Sons, NY, pp. 27–29 (1975).
Chemical Abstracts Index Guide, p. 724G (1990).
Grant, Roger & Claire Grant (1987) Grant & Hackh's Chemical Dictionary, New York: McGray–Hill, Inc. pp. 232 & 349.

* cited by examiner

*Primary Examiner*—Christopher D. Rodee
(74) *Attorney, Agent, or Firm*—Burns, Doane, Swecker & Mathis, LLP

(57) ABSTRACT

This invention provides a two-component developer comprising magnetic carrier particles and toner particles which contain magnetic particles at a specified content, being excellent in high speed copying system.

13 Claims, 3 Drawing Sheets

TWO COMPONENT DEVELOPER COMPRISING SPECIFIC MAGNETIC TONER AND SPECIFIC MAGNETIC CARRIER

This application is a continuation of application Ser. No. 08/324,532 U.S. Pat. No. 5,663,027, filed Oct. 18, 1994, which is a continuation of application Ser. No. 08/118,284 abandoned filed Sep. 9, 1993, which is a continuation of application Ser. No. 07/891,926, filed Jun. 1, 1992 abandoned, which is a continuation of application Ser. No. 07/634,395 filed Dec. 27, 1990 abandoned.

BACKGROUND OF THE INVENTION

This invention relates to a two-component developer comprising a magnetic carrier and a magnetic toner.

In general, a two component developer is composed of a non-magnetic toner which does not contain magnetic particles and a magnetic carrier. In such a two component developer, toner particles are brought into tribocontact with carrier particles to be charged electrically. The toner particles stick to carrier particles electrostatically. The carrier particles are transferred on a sleeve to a developing region by magnetic force as they are rolling or dragging magnetically. Toner particles are also transferred continuously along with the carrier particles to the developing region.

The toner and the carrier used in the conventional two-component developer have been studied for the improvement of various properties. In particular, when the carrier is a binder-type and small in particle size, the toner can be contained at higher content than conventional. Therefore, the latitude of toner supply is enlarged and high quality and long life are achieved.

However, when the toner particles are not charged uniformly by tribocontact between the toner and the carrier, the charge amount of each toner particle is different. This is caused by the different size of toner particles and the electrification build-up properties of toner particles. Accordingly, small toner particles which are not charged sufficiently stick to the carrier particles weakly, and liable to leave from the carrier particles as they are rolled to be moved on a sleeve, with the result that the small toner particles come to fly in a copying machine. The flying toner particles cause the dirt inside the copying machine, the fogs in copied images and the like.

In general, the wind is blowing whirlingly in the specified direction inside the copying machine for removal of air. The flying toner particles are flowed with the wind toward various components. For example, the flying toner particles adhere to a wire line of an electric charger. If the wire line of the electric charger is made dirt by the adhered toner particles, the irregular charging of a photosensitive member, the defects of copied images and the like are brought about. When the dirt makes further progress, a number of toner particles accumulate on a toner-drop-prevention plate. The accumulated toner particles drop onto copying paper to make it dirt.

The flying toner particles cause the problems as above mentioned. But, these problems are not so serious when a copying process is repeated about 40000 times at low copying speed (about 15 cm/sec).

But, a high-speed copying process (about 45 cm/sec) has been required recently. In such a process, a developer is rolled and moved on a sleeve at much higher speed than before to generate much more flying toner particles. The problems caused by the flying toner particles have become more remarkable.

It is proposed to prevent from generating of flying toner particles, for example, that toner particles are charged smoothly or quickly to adhere strongly to carrier particles. But, the toner particles are moved at high speed and the flying toner particles generate inevitably. The suppress of the generation of flying toner is not sufficient.

On the other hand, a magnetic toner is known as one component toner. It may be proposed in order to prevent from generating of the flying toner particles that the magnetic properties of the magnetic toner is utilized to attract the toner particles onto a sleeve in a manner similar to carrier particles. But, such a conventional magnetic toner contains magnetic particles at the high content of about 30 wt %. Even if the magnetic toner is merely applied to a two-component developer as a toner component, the magnetic toner particles are hard to be transferred to electrostatic latent images and to form copied images with high density.

SUMMARY OF THE INVENTION

The object of the invention is to provide a developer in which toner flying is prevented, electrification build-up properties are excellent, fogs and toner-drop are not brought about, and developing properties are not lowered, even when it is utilized in a high-speed copying process.

The present invention relates to a two-component developer for developing electrostatic latent images comprising;

specific carrier particles comprising at least a resin and magnetic particles, and specific toner particles comprising at least a binder resin, a colorant and magnetic particles.

DETAILED DESCRIPTION OF THE INVENTION

Figure 1:
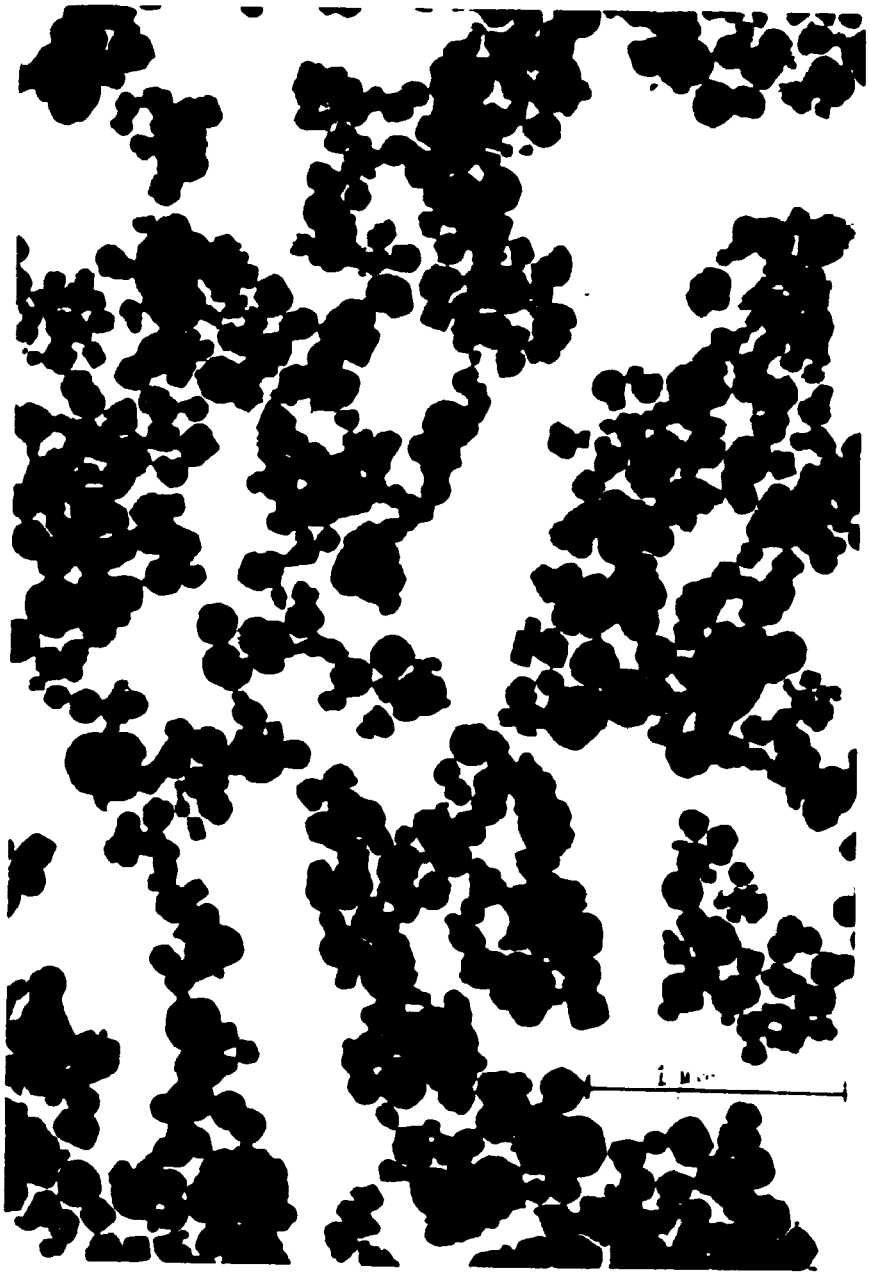
FIG. 1 shows the photograph of grain structure (×30000) of magnetic particles, which are spherical.

The present invention provides a two-component developer in which toner flying is prevented, electrification build-up properties are excellent, fogs and toner-drop are not brought about, and developing properties are not lowered, even when it is utilized in a high-speed copying process.

The present invention has accomplished the above object by incorporating magnetic particles into toner particles at a specified content.

The developer of the present invention comprises at least magnetic carrier particles and toner particles containing magnetic particles. The carrier particles and toner particles are explained in order hereinafter.

With respect to the carrier particles, any type of carrier particles may be applied to the present invention. Preferable carrier is composed of at least magnetic particles dispersed in a binder resin.

The binder resin used for preparing the carrier particles is exemplified by a polyester resin of bisphenol type, which is prepared by condensing an alcohol component, such as bisphenol A added with ethylene oxide or propylene oxide, with a carboxylic acid component, such as dicarboxylic acids, tricarboxylic acids or carboxylic acids having $C_4$–$C_{20}$ side chains, a polyester resin constituted of ethylene glycol as a main component, a rosin glycidyl ester or the like. A styrene-acrylic copolymer may be used as a binder resin. Preferable binder resin is the one having the viscosity of $10^5$–$10^7$ cps at 100° C. If the viscosity is higher than $10^7$ cps at 100° C., it becomes hard to knead the binder resin, and binding properties of the magnetic particles to the resin become poor. If the viscosity is lower than $10^5$ cps, the dispersing properties of the magnetic particles is the resin become poor, and the magnetic particles are liable to aggregate together.

With respect to the magnetic particles, they are not particularly limited in the present invention so far as the electrical resistivity is $10^7$ Ω·cm or more. Preferable one is ferrite. Concrete examples of ferrite, which are shown in the Japanese Patent KOKOKU No. 57-19055, have the general formula;

$$M'_{\frac{1-x}{1+x}(1-y)}\ Fe_{\frac{2x}{1+x}(1-y)}\ O_y$$

wherein M' is an atom selected from the group consisting of Ni, Co, Mg, Cu, Zn and Cd; "x" is within the range of between 0.5 and 1.0 and "y" is within the range of between 0.1 and 0.571. Another example of ferrite is the one represented by the formula:

$$(MO)_{x'}\cdot Fe_2O_3$$

in which M is an atom selected from the group consisting of Mg, Co, Ni, Cu, Zn and Mn, "x'" is an integer of 1, 2 or 3, Magnetite represented by $FeO\cdot Fe_2O_3$, metals containing ferromagnetic metals, such as iron, nickel, cobalt or the like, alloys or compounds of the metals may be used as a magnetic material in the present invention.

The magnetic particles are generally mixed with the binder resin at the ratio of 350–900 parts by weight on the basis of 100 parts by weight of the binder resin. Sufficient magnetization cannot be achieved if the magnetic fine particles are less than 350 parts by weight, and carriers become fragile if the magnetic particles exceed 900 parts by weight.

The carriers of the present invention can be prepared by mixing the binder resins with the magnetic particles sufficiently at the specified mixing ratio to be kneaded, by grinding the obtained mixture after cooling and classifying the resultant.

In the preferred embodiment of the invention, the mean particle size of the carriers are adjusted within the range of between 30–90 μm in weight average particle size in order to prevent the aggregation of carriers and the adherence thereof to an electrostatic latent image carrier more perfectly. The carriers tend to aggregate and adhere to and around the electrostatic latent image carrier and result in the deterioration of the carrier flowability, if the mean particle size of the carriers is less than 30 μm. Brushing surface irregularity and the like occur as can be similarly seen in iron particle carriers and clean images cannot be formed, if the mean particle size of the carriers is more than 90 μm. Further, the carriers of the invention may be given;

(a) the surface treatment by fine particles such as silica, titanium oxide, aluminum oxide, etc.

(b) the heat treatment in order to modify the surface of the carriers.

Then, the toner particles are explained hereinafter.

The toner particles of the present invention contain at least magnetic particles and a colorant dispersed in a binder resin. The magnetic particles may be the same as those described in the carrier particles, being not particularly limited. When toner particles are positively charged, preferable magnetic particles are the one represented by $(MO)_{x'}\cdot Fe_2O_3$ in which "M" and "x'" are the same as described above.

The magnetic particles are contained at the content of 0.5–15 parts by weight, preferably 1–10 parts by weight, more preferably 2–6 parts by weight on the basis of 100 parts by weight of the binder resin of the toner particles.

If the content is less than 0.5 parts by weight, toner flying is not prevented effectively. If the content is more than 15 parts by weight, it becomes hard that toner particles are developed effectively. That is, the toner particles are not developed onto electrostatic latent images sufficiently and the density of copied images (ID) are lowered.

When the content of the magnetic particles contained in the binder-type carrier is referred to as "a" and the content of the magnetic particles contained in the toner is referred to as "b", the ratio of "a/b" is within the range between about 30–1800.

The size of magnetic particles contained in toner particles is 0.05–1.0 μm, preferably 0.05–0.20 μm, and more preferably 0.05–0.15 μm in mean particle size when the toner particles are 3–8 μm in mean particle size.

Preferable magnetic particles contained in toner particles are spherical.

The photograph of grain structure of spherical fine magnetic particles (which is used in preparing toner 18) (×30000) is shown in FIG. 1. These particles have 0.11 μm in mean particle size, and each particle is spherical.

Figure 2:
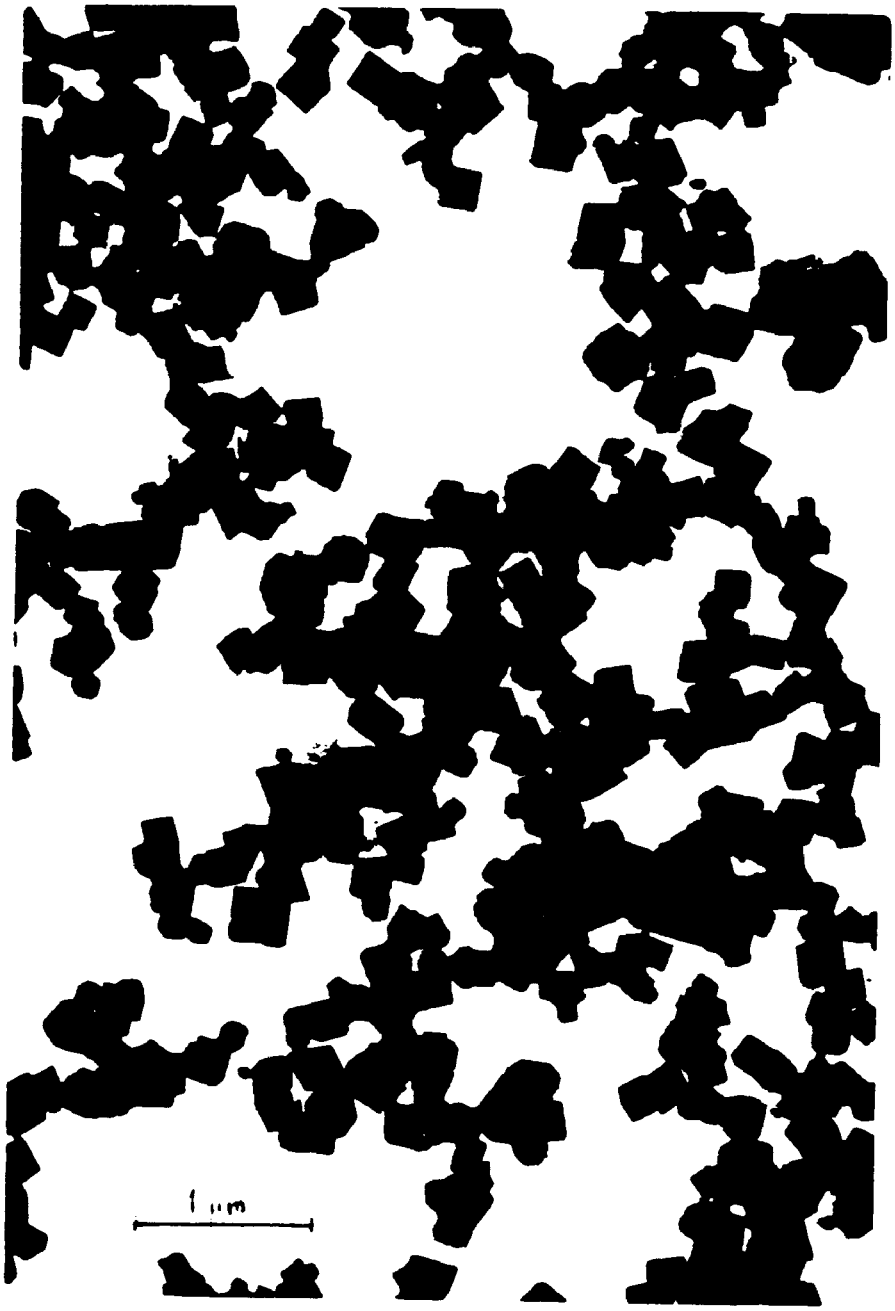
FIG. 2 and FIG. 3 show the photographs of grain structures (×30000) of magnetic particles, which are polyhedral. Each particle is squarer than that of FIG. 1.
Figure 3:
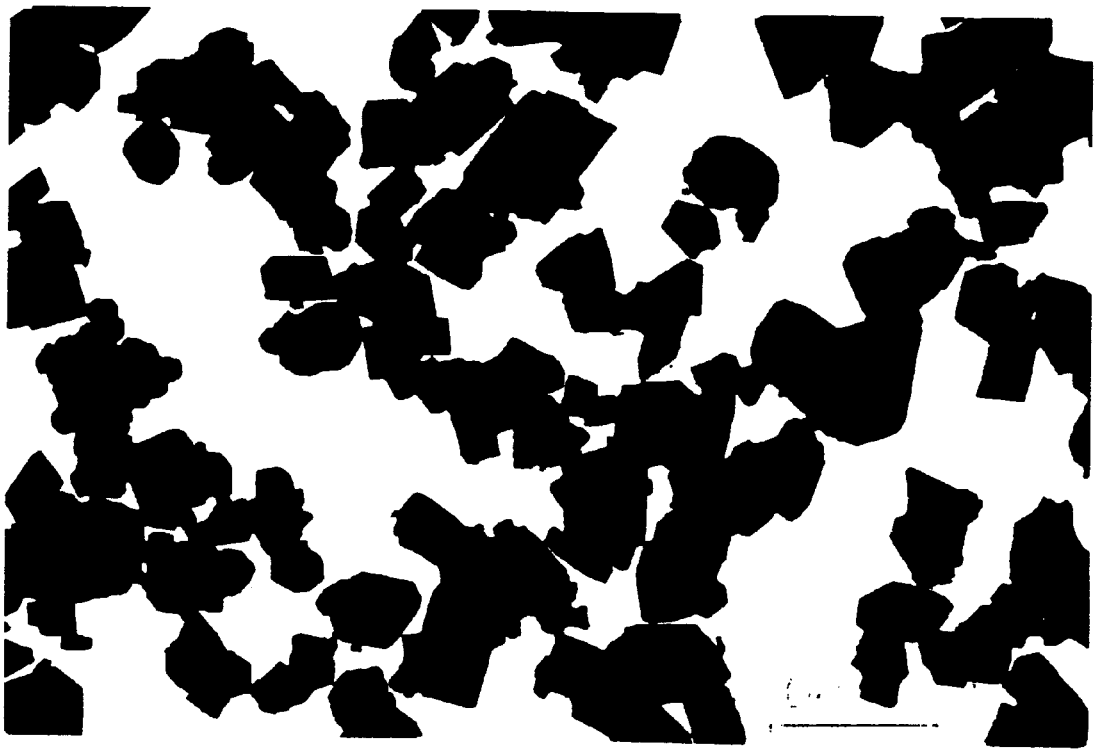

On the contrary, the photographs of grain structures of polyhedral magnetic particles are shown in FIG. 2 and FIG. 3. FIG. 2 shows the magnetic particles used for preparing Toner 1, and FIG. 3 shows the magnetic particles used for preparing Toner 7.

Toner is generally prepared by kneading a binder resin and magnetic particles, and grinding the resultant. Accordingly, parts of magnetic particles crop out from the surface of carrier particle. When the toner particles are not constituted of spherical magnetic particles but constituted of polyhedral magnetic particles, the toner particles transferred onto a photosensitive member scratch the surface thereof. This scratching problem is solved by incorporating spherical magnetic particles into toner particles.

The binder resin used for preparing toner particles is a thermoplastic resin, which is not particularly limited so far as it can be sufficiently softened at fixing temperature and has a glass point suitable for stable preservation.

The binder resin desirable for high speed developing system is the thermoplastic resin having the lowest possible softening point. In embodiment, the binder resin has number average molecular weight (Mn), weight average molecular weight (Mw) and Z average molecular weight (Mz) satisfying the relationship below;

$$1000 \leqq Mn \leqq 7000$$

$$40 \leqq Mw/Mn \leqq 70$$

$$200 \leqq Mz/Mn \leqq 500.$$

With regard to the number average molecular weight, more preferable Mn is 2000–7000.

Other kinds of thermoplastic resins, which may have the molecular weight out of the range as above mentioned may be added to improve fixing properties so far as the effects of the present invention are not impaired. The kind of such a thermoplastic resin is exemplified by a polystyrene, a copolymer of styrene with acrylic ester or methacrylic ester, a polyester prepared by condensing at least one diol component selected from the one of a bisphenol type or a rosin type with at least one dicarboxylic acid and/or a tricarboxylic acid selected from aromatic dicarboxylic acids, such as o-phthalic acid, isophthalic acid, terephthalic acid and the like, aliphatic dicarboxylic acids, such as maleic acid, adipic acid and the like, and trimellitic acid. The fixing temperature is adequately adjusted in consideration of the softening point of the thermoplastic resin.

The mean molecular weight of the thermoplastic resin (Mn, Mw, Mz) is measured by means of GPC (gel permeation chromatography). That is, the solution containing the binder resin dissolved in a solvent is passed through porous gel to separate molecules of high molecular weight and low molecular weight utilizing the different permeation speed passing through the pores. The separated molecules are provided for a differential refractometer to calculate the molecular weight on the basis of standard polystyrene.

A colorant employed in the present invention is not particularly limited, but exemplified by carbon black, acetylene black, zinc yellow, cadmium yellow, yellow oxide, mineral fast yellow, chrome orange, molybdenum orange, permanent orange GTR, pyrazolone orange, vulcan orange, red oxide, cadmium red, red lead oxide, cadmium mercury sulfide, permanent red 4R, manganese violet, fast violet B, methyl violet lake, prussian blue, cobalt blue, alkali blue lake, victoria blue lake, phthalocyanine blue, chrome green, chrome oxide, pigment green B, malachite green lake, fanal yellow green, zinc white, titanium oxide, barium carbonate, clay, silica, white carbon and the like.

One or more than two of these colorants can be mixed. Other organic or inorganic pigments can be available, if they are pollution-free, and have high coloring power.

Other additives may be incorporated into toner particles of the present invention. For example, a charge controlling agent may be incorporated in order to give chargeability.

Examples of charge controlling agent excellent in negative chargeability are hydroxy-substituted naphthoic acid, an alkyl derivative thereof, a hydroxy-substituted tetrahydronaphthoic acid, an alkyl derivative of salicylic acid, a metal complex salt represented by the following general formula;

in which $X_1$ is a hydrogen atom, a lower alkyl group, a lower alkoxy group, a nitro group or a halogen atom; $n_1$ is an integer of 1 or 2, and $m_1$ is an integer of 1, 2 or 3. X may be same; $M_1$ is a chromium atom or a cobalt atom; $A^+$ is a hydrogen ion, a sodium ion, a potassium ion or an ammonium ion; a metal complex salt represented by the following general formula:

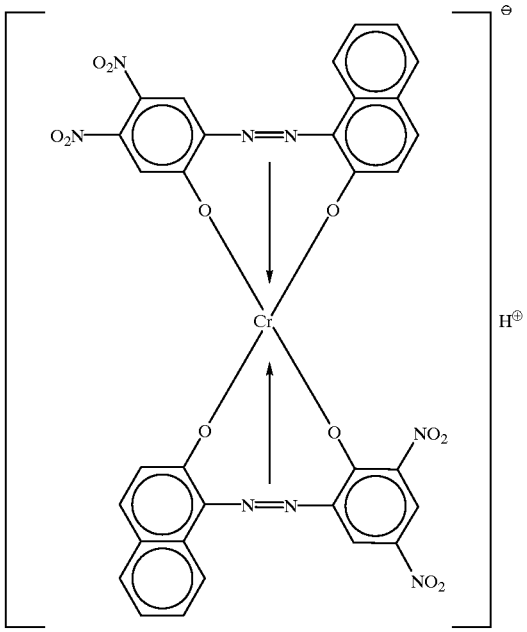

or a metal complex salts represented by the following general formula:

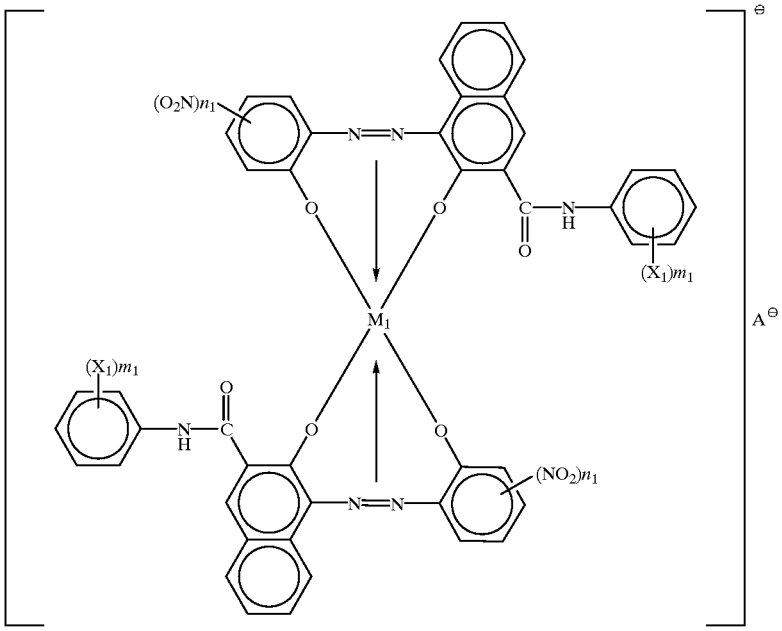

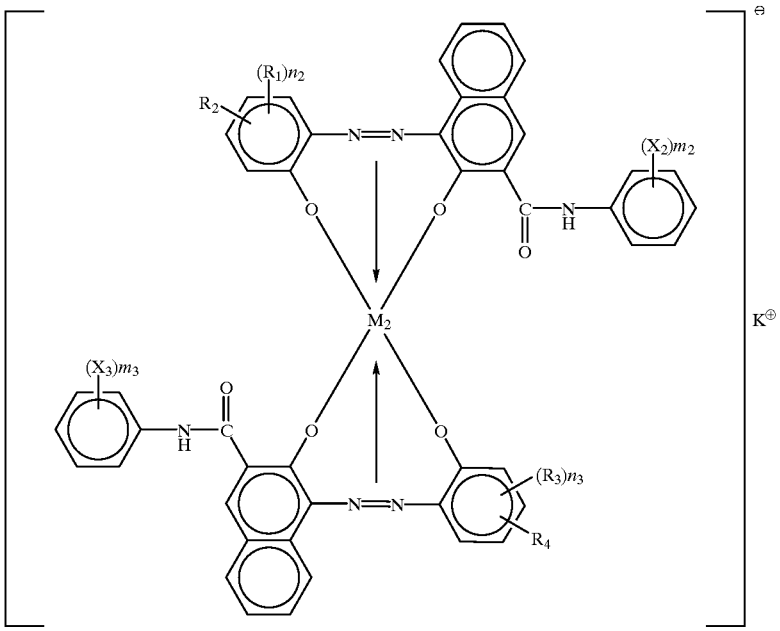

in which $X_2$ and $X_3$ are a hydrogen atom, a lower alkyl group, a lower alkoxy group, a nitro group or a halogen atom respectively; $X_2$ and $X_3$ may be same; $m_2$ and m3 are an integer of 1, 2 or 3 respectively; $R_1$ and $R_2$ are a hologen atom respectively; $R_1$ and $R_2$ may be same; $n_2$ and $n_3$ are an integer of 1, 2 or 3 respectively; $R_2$ and $R_4$ are a hydrogen atom or a nitro group respectively; $M_2$ is a chromium atom or a cobalt atom; $K^+$ is a hydrogen atom, a sodium ion or an ammonium ion. Further, 2-acrylamide-2-methyl propane sulfonic acid is copolymerized with styrene etc. to use as a charge controlling agent in combination with the charge controlling agent as above mentioned, with the result that the electrification build-up properties are improved and toner-flying can be suppressed.

Electron-donating dyes, such as nigrosine dyes, are generally used as a charge controlling agent effective for positive chargeability. Other examples are alkoxylated amine, quarternary ammonium salt, alkyl amide, phosphorous itself or a compound thereof, tungsten itself or compound thereof, a pigment chelated with molybdic acid, dibutyl tin oxide or a nitrogen-containing compound, which may be used singly or in combination.

Copolymers of vinyl monomers containing an amino group, such as dimethylaminoethyl methacrylate or diethylaminoethyl methacrylate with styrene may be used in combination with the charge controlling agent as above mentioned, with the result that the electrification build-up properties are improved and toner-flying can be suppressed.

Further, other additives, such as wax may be added into the toner of the present invention. The surface of toner particles may be treated with ultrafine particles of metal oxides.

The binder resin, colorants, magnetic particles, other necessary additives are mixed to prepare a toner of the present invention by an usual method, such as a grinding method, so-called suspension polymerization method in which materials other than main resin are dispersed in monomer and then the materials are incorporated into the binder resin when the monomer is polymerized, a granulating method in which a spray drier is used. Other methods of preparing toner particles may be used. The size of toner particles are adjusted within the range of 3–20 $\mu$m.

The obtained toner is mixed at the content of 4–15 wt % on the basis of the total amount of the toner and carrier to prepare a developer. The developer contains toner particles at high content. Therefore, the latitude of toner supply is enlarged.

The developer of the present invention does not bring about various problems caused by toner flying even when it is used in high developing system (30–50 cm/sec). The developer exhibits excellent electrification build-up properties and does not cause deterioration of developing properties, fogs and toner drop.

Specific examples are shown below.

Synthesis of Binder Resin

Synthesis of Polyester Resin (1)

Polyoxypropylene(2,2)-2,2-bis(4-hydroxyphenyl) propane of 490 g, polyoxyethylene(2,2)- 2,2-bis-(4-hydroxy-phenyl)propane of 190 g, terephthalic acid of 170 g, n-dodecyl succinate of 230 g and dibutyl tin oxide of 0.05 g were put into a four-necked flask with 1 liter capacity equipped with a thermometer, a stirrer made of stainless steel, a condenser of falling type and a nitrogen inlet. The contents were heated to 270° C. by means of a mantle heater and treated under nitrogen flow until water did not generate.

Then, trimellitic acid of 58 g was further added. The reaction was further continued until the acid value was 9 mg KOH/g. Then, the reaction was stopped by cooling.

The acid value of the obtained polyester was 9 mg KOH/g and hydroxy value thereof was 16 mg KOH/g.

The physical properties were measured by means of a flow tester to obtain the softening point (Tm): 124° C., the viscosity at 100° C. ($\eta_{100}$): $3.0\times10^6$ poise, -d(log$\eta$)/dT: $4.0\times10^2$ and the moisture adsorption: 0.66%.

The resultant was referred to as Polyester Resin (1).

Synthesis of Binder Resin

Synthesis of Polyester Resin (2)

Polyoxypropylene(2,2)-2,2-bis(4-hydroxyphenyl) propane of 500 g, polyoxyethylene(2,2)-2,2-bis-(4-hydroxy-phenyl)propane of 190 g, terephthalic acid of 190 g, n-dodecenyl succinate of 220 g and dibutyl tin oxide of 0.05 g were put into a four-necked flask with 1 liter capacity equipped with a thermometer, a stirrer made of stainless steel, a condenser of falling type and a nitrogen inlet. The contents were heated to 270° C. by means of a mantle heater and treated under nitrogen flow until water did not generate.

Then, trimellitic acid of 58 g was further added. The reaction was further continued until the acid value was 6 mg KOH/g. Then, the reaction was stopped by cooling.

The acid value of the obtained polyester was 6 mg KOH/g and hydroxy value thereof was 18 mg KOH/g.

The physical properties were measured by means of a flow tester to obtain the softening point (Tm): 124° C., the viscosity at 100° C. ($\eta_{100}$): $3.2\times10^6$ poise, -d(logη)/dT: $4.2\times10^2$ and the moisture adsorption: 0.75%.

The resultant was referred to as Polyester Resin (2).

Preparation of Carrier I

| ingredients | Parts by weight |
|---|---|
| Polyester Resin (I) | 100 |
| Carbon Black (MA#8; made by Mitsubishi Kasei K.K.) | 2 |
| Silica (Aerosil #200; made by Aerosil K.K.) | 1.5 |
| Zn-type Ferrite (maximal magnetization: 72 emu/g, Hc: 110, specific volume electric resistance: $3 \times 10^8$ 1 · cm) | 500 |

The above ingredients were mixed sufficiently. Then, the mixture was heated and kneaded. After cooling, the obtained block of mixture was pulverized and classified to obtain Carrier (I) of 53 μm in mean particle size.

The electric resistance of Carrier (I) was $8\times10^{13}$ Ω·cm.

Preparation of Carriers II–IX

Carriers II–IX were prepared in a manner similar to Preparation of Carrier I, except that the amount of Zn-type ferrite shown in Table 1 below was incorporated. The mean particle size and the electric resistance of the obtained carrier were also shown in Table 1.

TABLE 1

| Carrier | Mean particle size (μm) | Zn-type Ferrite (parts by weight) | electric resistance (Ω · cm) |
|---|---|---|---|
| I | 53 | 500 | $8 \times 10^{13}$ |
| II | 42 | 500 | $9 \times 10^{13}$ |
| III | 78 | 500 | $7 \times 10^{13}$ |
| IV | 26 | 500 | $4 \times 10^{13}$ |
| V | 95 | 500 | $1 \times 10^{13}$ |
| VI | 71 | 400 | $6 \times 10^{14}$ |
| VII | 69 | 200 | $8 \times 10^{14}$ |
| VIII | 55 | 950 | $2 \times 10^{10}$ |
| IX | 52 | 850 | $1 \times 10^{13}$ |

Preparation of Carrier X

The ingredients below were mixed sufficiently. Then, mixture was heated and kneaded. After cooling, the block of the mixture was pulverized and classified to obtain Carrier X of 56 μm in mean particle size.

| ingredients | Parts by weight |
|---|---|
| Polyester Resin (2) | 100 |
| Carbon Black (MA#44; made by Mitsubishi Kasei K.K.) | 2 |
| Silica (Aerosil #200; made by Aerosil K.K.) | 1.5 |
| Zn-type Ferrite (maximal magnetization: 72 emu/g, Hc: 110, specific volume electric resistance: $3 \times 10^8$ Ω · cm) | 500 |

Preparation of Carrier XI

The same ferrite particles of Zn-type as used in Preparation of Carrier I were coated with polyethylene resin by means of spray drying to obtain Carrier XI in mean particle size.

The mean thickness of coating layer was 1.2 μm. The content of polyethylene resin was 1 wt % or less.

Preparation of Toner 1

| ingredient | parts by weight |
|---|---|
| Thermoplastic styrene-acrylic resin (Mn: 4200, Mw: 210900, Mz: 1323000, Mw/Mn: 50.2, Mz/Mn: 315, Tg: 62.1° C., softening point: 115° C., acid value: 25.8) | 100 |
| Polypropylene of low molecular weight (pyrolysis product of polypropylene, viscosity at 160° C.: 145 cps) as an additive for preventing offset | 4 |
| Carbon Black (MA#100; made by Mitsubishi Kasei K.K.) | 8 |
| Bontron N-01 (one of Nigrosine dyes; made by Oriento Kagaku Kogyo K.K.) | 4 |
| Magnetic Particles; Magnetite EPT-1000 (0.28 μm in mean particle size; made by Toda Kogyo K.K.) | 1 |

The ingredient above were put into Henschel Mixer with capacity of 10 liters and mixed at 2000 rpm for 2 minutes. Then, the mixture was kneaded and extruded continuously in PCM30 (l/d:32.5).

Then, the obtained block of the mixture was ground coarsely by means of a feather mill to pass through 2 mm meshes. The obtained particles were further pulverized by use of a jet grinder and classified by a classifier of air borne type to remove fine particles and coarse particles. Thus, toner particles having 9.2 μm in mean particle size were obtained.

The obtained toner was treated with hydrophobic silica (R-974; made by Nippon Aerosil K.K.) at the ratio of 0.2 wt %.

The resultant toner was referred to as Toner 1.

Preparation of Toners 2–6

Toners 2–6 were prepared in a manner similar to Preparation of Toner 1, except that the amount of magnetic particles:

0.2 parts by weight (Toner 2), 5 parts by weight (Toner 3), 10 parts by weight (Toner 4), 15 parts by weight (Toner 5) and 20 parts by weight (Toner 6) were used.

Preparation of Toner 7

| ingredient | parts by weight |
|---|---|
| Thermoplastic polyester resin (Mn: 3400, Mw: 213400, Mz: 1183200, Mw/Mn: 62.8, Mz/Mn: 348, acid value: 16.7 softening point: 109° C., Tg: 64° C.) | 100 |
| Oxidized type of polypropylene of low molecular weight (pyrolysis product of polypropylene, viscosity at 160° C.: 140 cps, acid value: 5) as an additive for preventing offset; | 5 |
| Carbon Black (#44; made by Mitsubishi Kasei Kogyo K.K.) | 7 |
| Bontron S-34 (Cr-containing dye soluble in oils; made by Orient Kagaku Kogyo K.K.) | 3 |
| Magnetic Particies: Magnetite RB-BL (0.52 μm in mean particle size; made by Titan Kogyo K.K.) | 10 |

The ingredients above were treated in a manner similar to Preparation of Toner 1 to obtain toner particles of 9.4 μm in mean particle size. The resultant was referred to as Toner 7.

The used thermoplastic resin in this toner preparation was obtained as follows;

Ethylene oxide added with bisphenol A (550 g), Propylene oxide added with bisphenol A (550 g), terephthalic acid of 410 g, anhydrous trimellitic acid of 45 g and xylene of 50 g were put into 4-necked flask with capacity of 4 liters and treated for 5 hours at 240° C. under nitrogen flow. Then, the temperature was raised to 270° C. and the reaction was carried out at the same temperature for 8 hours. The water, by-product of the reaction, was distilled out.

Comparative Example (Toner 8)

Toner 8 was prepared in a manner similar to Preparation of Toner 1, except that the magnetic particles were not used. Toner 8 was 9.3 μm in mean particle size.

Evaluation of Toners

Toners 1–8 were mixed with Carriers I–IX to prepare developers and evaluated as below. The results were shown in Table 2.

Measurement of Charge Amount

Toners 1–8 were combined with Carriers I–IX at 8 percents by weight to prepare developers as shown in Table 2.

Sixty grams of a developer were put into a poly bottle with a capacity of 100 cc and stirred at 120 rpm for 3 minutes, 10 minutes and 30 minutes to obtain a charge amount (Qf) respectively. The results were shown in Table 2.

Decreasing Ratio of Charge Amount Before and After Left in High Humid Conditions A developer, once stirred for 30 minutes to measure a charge amount Qf (30 minutes) was left to stand for 3 days with the cap of the bottle open under the conditions of 35° C. and 85%, thereafter a charge amount (Qf (35° C., 85%, 3 days)) was measured to calculate a decreasing ratio of the charge amount according to the formula below;

$$\text{decreasing ratio \%} = \frac{Qf(30\text{ minutes}) - Qf(35^\circ\text{C., 85\%, 3 days})}{Qf(30\text{ minutes})} \times 100$$

When decreasing ratio (%) is;

below 10%; there is no problem,

10–15%; image density slightly increases and toner dropping is observed under high humidity, high temperature, but there is no problem for practical use.

16% or more; the developer can not be put into practical use.

Measurement on the Flying

Toner was mixed with developer at 10 wt %.

A flying amount of toner particles was measured as below after a developer was stirred for 3 minutes.

The flying amount was measured by means of a digital dust measuring apparatus (made by Shibata Kagakusha K.K.). Ten grams of the developer containing a toner at the ratio of 10 wt % were set on a magnet roller with a sleeve mounted therearound. The magnet roller was revolved at 1000 rpm (corresponding to 45 cm/sec in high speed developing system). Then, the dust measuring apparatus detected toner particles flying about as a dust for 1 minute, and displayed a resultant value in the number of counts per minute, i.e. cpm.

When the cpm is 100 or less, there is no practical problem.

Three hundred or less of cpm is a normal flying amount and there is almost no troubles caused by toner flying in a copying machine. When the cpm was 500 or more, in particular, 1000 cpm or more, such a lot of toner flying amount results in dusts of copying machine and troubles, such as fogs.

The results were shown in Table 3.

Test of Copied Images

One of Toners and one of Carriers were put into a poly bottle with a capacity of 1 liter such that the toner was contained at 8 percents by weight. Then, the polybottle was revolved at 120 rpm for 10 hours to prepare a developer.

The obtained developer was subjected to durability test with respect to copy of 100000 sheets of copying paper using a converted copying machine EP 870 (made by Minolta Camera K.K.), which had a laminated organic photosensitive member.

The results were ranked as below;

5: no fogs

4: little fogs

3: a little fogs; no practical problems

2: a number of fogs

1: noticeable fogs

Adherence of Carrier

It was observed if carrier particles adhered to copied images or therearound. The results were ranked below;

◎: No adherence of carrier was observed

○: A little adherence of carrier was observed around copied images

Δ: Adherence of carrier was observed in copied images and unevenness of copied images were observed here and here.

x: Much adherence of carrier was observed.

Toner Dropping in Copying Machine

Flying toner in the copying machine and dropped toner from the developer were observed after the copying process was repeated 100000 times. The results were ranked as follows:

◎: No dirt was observed in the copying machine

○: There was almost no problem in practical use.

Δ: There was no problem upto 10000 times repetition, but after 50000 times repetition, the cleaning in the copying machine was needed.

x: If the copying machine was not cleaned before 20000 times of copying process were repeated, dirt of copying paper, unevenness of copied images, unevenness of transferring were observed.

Filming Phenomenon

A thin film formed with one or more compositions of a toner on a photosensitive member causes the deterioration of photosensitivity of a photosensitive member, increase of residual potential, resulting in the generation of fogs.

The developer was provided for a copying machine EP870 (copying speed of 35.0 cm/sec; made by Minolta Camera K.K.) to be subjected to durability test with respect to copy. After 100000 times of copy were repeated, the surface of the photosensitive member was evaluated.

The degree of fogs were ranked as below;

◎: no filming phenomenon

○: there is no practical problem. However, the portion where a developer was contacted with is different in gloss from the portion where a developer was not contacted with.

Δ: a thin film was formed. more than usual exposure amount was needed x: filming phenomenon was observed remarkably when images of half-tone were copied, the shades of a film were noticeable.

xx: the copying machine could not adjust the exposure amount suitably.

Cleaning Properties

Cleaning properties were evaluated to copy solid black paper 50 times after copying process was repeated 50000 times or 10000 times. The evaluation was ranked as follows;

◎: no cleaning failure,

○: a little cleaning failure is observed, but there is no practical problem,

Δ: cleaning failure is observed linearly, x: cleaning failure is observed frequently.

Density of Copied Images

Density of copied images was measured by Macbeth densitometer at first stage of copying process, and after 10000 times and 100000 times of copying process.

Total Evaluation

The developers were evaluated totally referring to the results as above mentioned. The evaluation was ranked as follows;

◎: the developer can be put into practical use safely, x: the developer is poor in reliability and has many problems to be improved.

TABLE 2

| Test No. | Carrier | Toner | Charge Amount 3 min μc/g | Charge Amount 10 min μc/g | Charge Amount 30 min μc/g | change with time % | flying amount | copied images fogs 10K | copied images fogs 100K | copied images carrier adherence 10K | copied images carrier adherence 100K |
|---|---|---|---|---|---|---|---|---|---|---|---|
| 1 | I | 1 | 13 | 14 | 14 | 12 | 225 | 5 | 4 | ◎ | ◎ |
| 2 | I | 2 | 12 | 14 | 15 | 28 | 878 | 4 | 2 | ◎ | ◎ |
| 3 | I | 3 | 13 | 13 | 14 | 8 | 133 | 5 | 4 | ◎ | ◎ |
| 4 | I | 4 | 12 | 13 | 13 | 6 | 95 | 5 | 5 | ◎ | ◎ |
| 5 | I | 5 | 11 | 12 | 13 | 6 | 62 | 5 | 5 | ◎ | ◎ |
| 6 | I | 6 | 10 | 11 | 12 | 5 | 33 | 5 | 4 | ◎ | ◎ |
| 7 | I | 7 | −13 | −14 | −14 | 6 | 87 | 5 | 5 | ◎ | ◎ |
| 8 | I | 8 | 11 | 13 | 15 | 34 | 1654 | 4 | 1 | ◎ | ◎ |
| 9 | II | 7 | −14 | −15 | −15 | 7 | 93 | 5 | — | ◎ | — |
| 10 | III | 7 | −12 | −13 | −13 | 5 | 107 | 5 | — | ◎ | — |
| 11 | IV | 7 | −15 | −16 | −16 | 9 | 85 | 5 | — | x | — |
| 12 | V | 7 | −10 | −11 | −12 | 13 | 88 | 4 | 2 | ◎ | ◎ |
| 13 | VI | 7 | −13 | −14 | −15 | 12 | 78 | 5 | — | ◎ | — |
| 14 | VII | 7 | −12 | −14 | −16 | 24 | 69 | 3 | — | x | — |
| 15 | VIII | 7 | −10 | −12 | −15 | 45 | 101 | 3 | — | x | — |
| 16 | IX | 7 | −11 | −13 | −15 | 19 | 66 | 5 | — | ◎ | — |

| Test No. | inside copying machine toner drop | filming on photo-sensitive member | cleaning properties 50K | cleaning properties 100K | density of copied image initial | density of copied image 10K | density of copied image 100K | total |
|---|---|---|---|---|---|---|---|---|
| 1 | ◎ | ○ | ◎ | ○ | 1.53 | 1.50 | 1.48 | ◎ |
| 2 | Δ | Δ | Δ | x | 1.57 | 1.36 | 1.11 | x |
| 3 | ◎ | ○ | ◎ | ○ | 1.51 | 1.48 | 1.46 | ◎ |
| 4 | ◎ | ○ | ◎ | ○ | 1.45 | 1.44 | 1.43 | ◎ |
| 5 | ◎ | ○ | ◎ | ○ | 1.21 | 1.33 | 1.32 | ◎ |
| 6 | ◎ | ○ | ◎ | ○ | 0.53 | 0.62 | 0.57 | x |
| 7 | ◎ | ○ | ◎ | ○ | 1.42 | 1.43 | 1.41 | ◎ |
| 8 | x | x | x | x | 1.55 | 1.31 | 1.08 | x |
| 9 | ◎ | ◎ | — | — | 1.40 | 1.42 | — | ◎ |
| 10 | ◎ | ◎ | — | — | 1.45 | 1.44 | — | ◎ |
| 11 | ○ | ◎ | — | — | 1.36 | 1.38 | — | x[1)] |
| 12 | Δ | ○ | ◎ | ◎ | 1.25 | 1.14 | 0.85 | x[2)] |
| 13 | ○ | ○ | — | — | 0.32 | 1.25 | — | ◎ |

TABLE 2-continued

| | | | | | | | | |
|---|---|---|---|---|---|---|---|---|
| 14 | ○ | ○ | — | — | 1.42 | 1.15 | — | x[3)] |
| 15 | ○ | ○ | — | — | 1.38 | 0.92 | | x[4)] |
| 16 | ○ | ◎ | — | — | 1.50 | 1.44 | — | ◎ |

[1)]Carrier was liable to adhere.
[2)]The developer containing Carrier V and Toner 7 formed white lines in solid copied images caused by a cleaning brush. The copied images of characters were developed successively, resulting in that fine lines were broken and the characters could not be read.
[3)]Remarkable adherence of carrier was observed.
[4)]Change with time was remarkable and carrier was developed into copied images and white spots were formed in copied images.

Preparations of Toners 9–12

| ingredient | parts by weight |
|---|---|
| Thermoplastic styrene-acrylic resin (Mn: 4800, Mw: 243800, Mw/Mn: 50.8, Tg: 64.0° C., softening point: 118° C., acid value: 20.6) | 100 |
| Polypropylene of low molecular weight (pyrolysis product of polypropylene, viscosity at 160° C.: 145 cps) as an additive for preventing offset | 4 |
| Carbon black (MA#100; made by Mitsubishi Kasei K.K.) | 8 |
| Bontron N-05 (one of Nigrosine dyes; made by Oriento Kagaku Kogyo K.K.) | 4 |
| Magnetic Particles; Ferrite Mno.Zno.$Fe_2O_3$ (δs: 66 emu/g, Hc: 120 Oe, BET: 1.4 $m^2/g$) | 5 |

The ingredient above were put into Henschel Mixer with capacity of 10 liters and mixed at 2000 rpm for 2 minutes. Then, the mixture was kneaded and extruded continuously in PCM 30 (l/d: 32.5).

Then, the obtained block of the mixture was ground coarsely by means of a feather mill to pass through 2 mm meshes. The obtained particles were further pulverized by use of a jet grinder and classified by a classifier of airborne type to remove fine particles and coarse particles. Thus, toner particles having 7.5 μm in mean particle size were obtained. The obtained toner was treated with hydrophobic silica (R-974; made by Nippon Aerosil K.K.) at the ratio of 0.2 wt %. The resultant toner was referred to as Toner 9.

Toners 10–12 having the same compositions as Toner 1. were prepared in a manner similar to preparation of Toner 1, except that magnetic particles shown in Table 3 were used.

TABLE 3

| Toner | kind of Ferrite | δs (emu/g) | Hc Oe | BET $m^2/g$ | particle size (μm) |
|---|---|---|---|---|---|
| 10 | $ZnO.Fe_2O_3$ | 65 | 87 | 5.6 | 7.3 |
| 11 | $NiO.Fe_2O_3$ | 67 | 24 | 3.8 | 7.6 |
| 12 | $MgO.Fe_2O_3$ | 60 | 53 | 2.9 | 7.4 |

Preparation of Toner 13

| ingredient | parts by weight |
|---|---|
| Thermoplastic polyester resin (Mn: 4400 Mw: 253000, Nw/Mn: 57.5, softening point 115° C., Tg: 68° C. acid value: 0.3) | 100 |
| Oxidized type of polypropylene of low molecular weight (pyrolysis product of polypropylene, viscosity at 160° C.: 145 cps) as an additive for preventing offset; | 5 |
| Carbon Black (#44; made by Mitsubishi Kasei Kogyo K.K.) | 7 |
| Magnetic Particles ($ZnO.Fe_2O_3$ Ferrite (δs: 65 emu/g, Hc: 870 Oe, BET: 5.6 $m^2/g$) | 5 |
| Nigrosine Base EX (one of Nigrosine dyes; made by Orient Kagaku Kogyo K.K.) | 3 |

The ingredients above were treated in a manner similar to preparation of Toner 1 to obtain toner particles of 9.3 μm in mean particle size. The resultant was referred to as Toner 13.

The used thermoplastic resin in this toner preparation was obtained as follows;

Ethylene oxide added with bisphenol A (550 g), Propylene oxide added with bisphenol A (550 g), terephthalic acid of 450 g, anhydrous trimellitic acid of 40 g and xylene of 50 g were put into 4-necked flask with capacity of 3 liters and treated for 5 hours at 240° C. under nitrogen flow. Then, the temperature was raised to 270° C. and the reaction was carried out at the same temperature for 8 hours. The water, by-product of The reaction, was distilled out.

Preparations of Toners 14–17

Toners 14–17 having the same compositions as Toner 9 were prepared in a manner similar to preparation of Toner 9, except that the amount of magnetic particles were used in Table 4.

TABLE 4

| Toner | Addition of Magnetic Particles (Parts by Weight) | Particle size (μm) |
|---|---|---|
| 14 | 0.2 | 7.5 |
| 15 | 5 | 7.5 |
| 16 | 15 | 7.4 |
| 17 | 20 | 7.5 |

Evaluation of Toner

Toners 9–17 were combined with Carrier X to prepare a developer and evaluated in a manner similar to Test Nos. 1–16 in Table 2. The results were shown in Table 5.

TABLE 5

| Test No. | Carrier | Toner | Charge Amount 3 min μc/g | 10 min μc/g | 30 min μc/g | change with time % | flying amount | copied images fogs 10K | fogs 100K | carrier adherence 10K | carrier adherence 100K |
|---|---|---|---|---|---|---|---|---|---|---|---|
| 17 | X | 9 | 12 | 13 | 15 | 8 | 246 | 5 | 4 | ◎ | ◎ |
| 18 | X | 10 | 13 | 14 | 16 | 10 | 189 | 5 | 4 | ◎ | ◎ |
| 19 | X | 11 | 10 | 12 | 13 | 6 | 285 | 5 | 3 | ◎ | ◎ |
| 20 | X | 12 | 14 | 16 | 17 | 13 | 96 | 5 | 5 | ◎ | ◎ |
| 21 | X | 13 | 10 | 12 | 14 | 14 | 253 | 5 | 4 | ◎ | ◎ |
| 22 | X | 14 | 9 | 13 | 16 | 25 | 1829 | 2 | — | ◎ | — |
| 23 | X | 15 | 11 | 13 | 15 | 9 | 281 | 5 | 4 | ◎ | ◎ |
| 24 | X | 16 | 13 | 14 | 14 | 6 | 43 | 5 | 5 | ◎ | ◎ |
| 25 | X | 17 | 10 | 12 | 12 | 7 | 25 | 5 | — | ◎ | — |

| Test No. | inside copying machine toner drop | filming on photo-sensitive member | cleaning properties 50K | cleaning properties 100K | density of copied image initial | 10K | 100K | total |
|---|---|---|---|---|---|---|---|---|
| 17 | ◎ | ◎ | ◎ | ◎ | 1.48 | 1.46 | 1.47 | ◎ |
| 18 | ◎ | ◎ | ◎ | ◎ | 1.42 | 1.43 | 1.40 | ◎ |
| 19 | ○ | ◎ | ◎ | ◎ | 1.50 | 1.46 | 1.42 | ◎ |
| 20 | ◎ | ◎ | ◎ | ◎ | 1.38 | 1.33 | 1.36 | ◎ |
| 21 | ◎ | ◎ | ◎ | ◎ | 1.46 | 1.44 | 1.43 | ◎ |
| 22 | (10K) | (10K) | (10K) | — | 1.51 | 1.32 | — | x |
| 23 | ◎ | ◎ | ◎ | ◎ | 1.52 | 1.50 | 1.46 | ◎ |
| 24 | ◎ | ◎ | ◎ | ◎ | 1.33 | 1.28 | 1.26 | ◎ |
| 25 | ◎ | ◎ | ◎ | ◎ (10K) | 0.72 | 0.68 | — | x |

Preparation of Toner 18

Toner 18 having mean particle size of 7.5 μm was prepared in a manner similar to preparation of Toner 1, except that magnetic particles Magnetite MER-1 (0.11 μm in mean particle size; made by Titan Kogyo K.K.) were used.

Preparation of Toners 19–23

Toners 19–23 were prepared in a manner similar to Preparation of Toner 18, except that the amount of magnetic particles;

0.1 parts by weight (Toner 19), 5 parts by weight (Toner 20), 10 parts by weight (Toner 21), 15 parts by weight (Toner 22) and 20 parts by weight (Toner 23) were used.

Preparation of Toner 24

Toner 24 having mean particle size of 7.7 μm was prepared in manner similar to preparation of Toner 7, except that magnetic particles Magnetite MER-1 (made by Titan Kogyo K.K.) were used.

The compositions of Toners 18–24 were summarized in Table 6.

TABLE 6

| Toner No. | Resin | Wax | Carbon Black | Charge Controlling Agent | Magnetic Particle | Additive | Mean Particle size of Toner |
|---|---|---|---|---|---|---|---|
| 18 | Thermoplastic St-Ac (100)* | Low Molecular Weight polypropylene (4) | MA#8 (8) | Bontrone N-13 (4) | MER-1 (5) | R-974 (0.2) | 7.5 μm |
| 19 | Thermoplastic St-Ac (100)* | Low Molecular Weight polypropylene (4) | MA#8 (8) | Bontrone N-13 (4) | MER-1 (0.2) | R-974 (0.2) | 7.6 μm |
| 20 | Thermoplastic St-Ac (100)* | Low Molecular Weight polypropylene (4) | MA#8 (8) | Bontrone N-13 (4) | MER-1 (1) | R-974 (0.2) | 7.3 μm |
| 21 | Thermoplastic St-Ac (100)* | Low Molecular Weight polypropylene (4) | MA#8 (8) | Bontrone N-13 (4) | MER-1 (10) | R-974 (0.2) | 7.5 μm |
| 22 | Thermoplastic St-Ac (100)* | Low Molecular Weight polypropylene (4) | MA#8 (8) | Bontrone N-13 (4) | MER-1 (15) | R-974 (0.2) | 7.4 μm |
| 23 | Thermoplastic St-Ac (100)* | Low Molecular Weight polypropylene (4) | MA#8 (8) | Bontrone N-13 (4) | MER-1 (20) | R-974 (0.2) | 7.2 μm |
| 24 | Thermoplastic polyester (100) | oxidized type polypropylene of low molecular weight (5) | MA#8 (8) | TRH (5) | MER-1 | R-974 (0.2) | 7.7 μm |

Evaluation of Toner

Toners 18–24 were combined with Carrier I, XI to prepare a developer and evaluated in a manner similar to Test Nos. 1–16 in Table 2. The results were shown in Table 7.

TABLE 7

| Test No. | Carrier | Toner | Charge Amount 3 min μc/g | 10 min μc/g | 30 min μc/g | change with time % | flying amount | copied images fogs 10K | fogs 100K | carrier adherence 10K | adherence 100K |
|---|---|---|---|---|---|---|---|---|---|---|---|
| 26 | I | 18 | 13 | 14 | 6 | 98 | 5 | 4 | ⊙ | ⊙ | |
| 27 | I | 19 | 14 | 17 | 25 | 1002 | 3 | 2 | ⊙ | ⊙ | |
| 28 | I | 20 | 14 | 15 | 4 | 207 | 4 | 4 | ⊙ | ⊙ | |
| 29 | I | 21 | 12 | 13 | 7 | 74 | 5 | 5 | ⊙ | ⊙ | |
| 30 | I | 22 | 11 | 12 | 9 | 51 | 5 | 5 | ⊙ | ⊙ | |
| 31 | I | 23 | 9 | 10 | 16 | 29 | 5 | 4 | ⊙ | ⊙ | |
| 32 | I | 24 | −13 | −14 | 5 | 66 | 5 | 5 | ⊙ | ⊙ | |
| 33 | XI | 18 | 14 | 15 | 5 | 79 | 5 | 5 | ⊙ | ⊙ | |

| Test No. | inside copying machine toner drop | filming on photo-sensitive member | cleaning properties 50K | cleaning properties 100K | wearing of photo sensitive member | density of copied image initial | 10K | 100K | total |
|---|---|---|---|---|---|---|---|---|---|
| 26 | ⊙ | ⊙ | ⊙ | ⊙ | ⊙ | 1.52 | 1.50 | 1.49 | ⊙ |
| 27 | x | x | Δ | x | ⊙ | 1.58 | 1.55 | 1.56 | x |
| 28 | ○ | ○ | ⊙ | ○ | ⊙ | 1.56 | 1.54 | 1.53 | ○ |
| 29 | ⊙ | ⊙ | ⊙ | ⊙ | ⊙ | 1.47 | 1.44 | 1.42 | ⊙ |
| 30 | ⊙ | ⊙ | ⊙ | ⊙ | ○ | 1.30 | 1.28 | 1.27 | ⊙ |
| 31 | ⊙ | ⊙ | ⊙ | ⊙ | x | 1.08 | 0.87 | 0.80 | x |
| 32 | ⊙ | ⊙ | ⊙ | ⊙ | ⊙ | 1.54 | 1.51 | 1.51 | ⊙ |
| 33 | ⊙ | ⊙ | ⊙ | ⊙ | ⊙ | 1.48 | 1.47 | 1.47 | ⊙ |

What is claimed is:

1. A two-component developer for developing electrostatic latent images comprising:

(a) carrier particles comprising a first binder resin and first magnetic particles which are dispersed in the first binder resin, the first magnetic particles being present in an amount in the range of from 350 to 900 parts by weight based on 100 parts by weight of the first binder resin, the first binder resin having a viscosity in the range of from $10^5$ to $10^7$ poise at 100° C., the first magnetic particles being selected from the group consisting of ferrite particles and magnetite particles, the ferrite particles being of the formula $(MO)_x \cdot Fe_2O_3$ in which M is a metal atom selected from the group consisting of Mg, Co, Ni, Cu, Zn and Mn, and X is an integer selected from 1, 2 and 3; and (b) toner particles comprising a second binder resin, a colorant and from 0.5 to 6 parts by weight of second magnetic particles based on 100 parts by weight of the second binder resin, the second magnetic particles being selected from the group consisting of ferrite particles and magnetite particles, the ferrite particles being of the formula $(MO)_x \cdot Fe_2O_3$ in which M is a metal atom selected from the group consisting of Mg, Co, Ni, Cu, Zn and Mn, and X is an integer selected from 1, 2 and 3.

2. The two-component developer according to claim 1, in which the second binder resin comprises a thermoplastic copolymer of styrene with acrylic ester or methacrylic ester.

3. The two-component developer according to claim 1, in which the first magnetic particles have a mean particle size in the range of from 0.05 to 1.0 μm.

4. The two-component developer according to claim 1, in which the second magnetic particles have a mean particle size in the range of from 0.05 to 1.0 μm.

5. The two-component developer according to claim 4, in which the first magnetic particles have a mean particle size in the range of from 0.05 to 1.0 μm.

6. The two-component developer according to claim 4, in which the second magnetic particles have a mean particle size in the range of from 0.05 to 0.2 μm.

7. The two-component developer according to claim 1, in which the second binder resin has a number average molecular weight (Mn) in the range of from 1000 to 7000, a ratio (Mw/Mn) of weight average molecular weight (Mw) to number average molecular weight (Mn) in the range of from 40 to 70, and a ratio (Mz/Mn) of Z average molecular weight (Mz) to number average molecular weight (Mn) in the range of from 200 to 500.

8. The two-component developer according to claim 1, in which surfaces of the toner particles are treated with metal oxide particles.

9. The two-component developer according to claim 8, in which the metal oxide particles are hydrophobic silica particles.

10. The two-component developer according to claim 1, wherein said toner particles further comprise a wax.

11. The two-component developer according to claim 1, in which the toner particles have a mean particle size in the range of from 3 to 8 μm.

12. The two-component developer according to claim 1, in which the toner particles have a mean particle size in the range of from 3 to 8 μm and are treated with metal oxide particles.

13. The two-component developer according to claim 12, in which the metal oxide particles are hydrophobic silica particles.

* * * * *